US007670275B2

(12) United States Patent
Schaack

(10) Patent No.: US 7,670,275 B2
(45) Date of Patent: Mar. 2, 2010

(54) PAPER SCORING SYSTEM

(75) Inventor: Dennis R. Schaack, Maple Grove, MN (US)

(73) Assignee: Bindery Parts Source, Inc., Chaska, MN (US)

( * ) Notice: Subject to any disclaimer, the term of this patent is extended or adjusted under 35 U.S.C. 154(b) by 0 days.

(21) Appl. No.: 11/749,420

(22) Filed: May 16, 2007

(65) Prior Publication Data

US 2008/0287276 A1 Nov. 20, 2008

(51) Int. Cl.
*B31B 1/25* (2006.01)

(52) U.S. Cl. ..... 493/403; 493/396; 493/400; 493/401; 493/402

(58) Field of Classification Search ..... 493/395–396, 493/400–403

See application file for complete search history.

(56) References Cited

U.S. PATENT DOCUMENTS

| | | | |
|---|---|---|---|
| 1,091,204 | A | 3/1914 | Ferres |
| 1,718,041 | A | 6/1929 | Galassi |
| 1,828,234 | A | 10/1931 | Swift, Jr. |
| 2,475,868 | A | 7/1949 | Anderson |
| 2,485,020 | A | 10/1949 | Staude |
| 3,157,398 | A | 11/1964 | Zahradnik |
| 3,318,206 | A | 5/1967 | Kuehn et al. |
| 3,550,935 | A | 12/1970 | Smith et al. |
| 3,827,340 | A | 8/1974 | Keck et al. |
| 3,880,030 | A | 4/1975 | Rosengren |
| 3,977,310 | A | 8/1976 | Keck et al. |
| 3,981,213 | A | 9/1976 | Lopman |
| 4,285,684 | A | 8/1981 | Smith |
| 4,289,492 | A | 9/1981 | Simpson |
| 4,367,061 | A | 1/1983 | Wiholm |
| 4,375,971 | A | 3/1983 | Moll |
| 4,417,883 | A | 11/1983 | Granger et al. |
| 4,936,818 | A | 6/1990 | Holohan, Jr. |
| 5,045,045 | A | 9/1991 | Davenport et al. |
| 5,133,235 | A | 7/1992 | DeVito |
| 5,152,522 | A | 10/1992 | Yamashita |
| 5,154,410 | A | 10/1992 | Baader et al. |
| 5,158,525 | A | 10/1992 | Nikkel |
| 5,194,064 | A | 3/1993 | Simpson et al. |

(Continued)

FOREIGN PATENT DOCUMENTS

WO WO 2004/078469 9/2004

OTHER PUBLICATIONS

Web cite for the "Tri-Creaser", Technifoldusa.com, pp. 1-5 printed Nov. 15, 2006.

(Continued)

*Primary Examiner*—Christopher Harmon
(74) *Attorney, Agent, or Firm*—Frederick W. Niebuhr; Haugen Law Firm PLLP

(57) ABSTRACT

A scoring system uses a grooved roller and a variety of resilient annular scoring tools. The scoring tools have scoring features or blades of different profiles, and further have annular bases uniform in width to enable their interchangeable installation into one or more tool-retaining grooves formed into the roller. The bases are much larger than the scoring features to provide increased strength and durability, along with more stable mounting of the scoring tool. In one version, a single roller assembly is formed by removably securing processing sleeves and spacing sleeves on a common support member.

36 Claims, 5 Drawing Sheets

U.S. PATENT DOCUMENTS

| | | | | |
|---|---|---|---|---|
| 5,409,442 | A | 4/1995 | Smithwick, Jr. | |
| 5,529,563 | A * | 6/1996 | Veith et al. | 493/395 |
| 6,159,137 | A | 12/2000 | Lee et al. | |
| 6,572,519 | B1 | 6/2003 | Harris | |
| 2002/0123418 | A1 | 9/2002 | Davison et al. | |
| 2003/0235660 | A1 | 12/2003 | Blanchard | |
| 2006/0027065 | A1 | 2/2006 | Spatafora | |
| 2006/0191426 | A1 | 8/2006 | Timmerman | |
| 2006/0229184 | A1 | 10/2006 | Powell | |
| 2007/0243988 | A1 | 10/2007 | Harris et al. | |

OTHER PUBLICATIONS

Web cite for Technifoldusa.com, pp. 1-2 printed Nov. 15, 2006.
"Tri-creaser Easy Fit", Technifold brochure.
Introducing the Innovative World of Tech-ni-fold; Global Leaders in Print Finishing Solutions Article from Technifold, 3 pages.

* cited by examiner

PAPER SCORING SYSTEM

BACKGROUND OF THE INVENTION

The present invention relates to rotary systems and equipment for high-speed processing of paper and card stock, and more particularly to systems and equipment designed to score (crease) and perforate such stock.

For many years, rotary devices have been used to cut, score and perforate paper and card stock in recognition of the considerably higher throughput rates afforded by such devices. In essence, the stock is fed between a processing (e.g. scoring) disc or roller and a counter-directionally rotated back-up disc or roller. The arrangement is particularly well-suited to process a continuous web of paper or card stock. U.S. Pat. No. 1,091,204 (Ferres) illustrates an early approach.

More recently, rigid processing tools have been used in combination with resilient opposing or back-up members, for example, as shown in U.S. Pat. No. 3,318,206 (Kuehn et al.) and U.S. Pat. No. 5,045,045 (Davenport et al.). Similarly, it is known to fabricate a resilient processing tool, for example the resilient compression rings shown in U.S. Pat. No. 3,977,310 (Keck). Each compression wheel, in the form of an O-ring, is seated in a groove formed into a rigid main body.

U.S. Pat. No. 6,572,519 (Harris) shows a creasing device in which creasing rings, more particularly rubber O-rings, are removably received in grooves formed into a rigid cylindrical male roller. A rigid female roller is provided with grooves corresponding to the O-ring locations. Harris advises that the male roller can have grooves of different widths to accommodate O-rings of different widths, and further that the grooves in the male roller can be formed to different depths to provide for O-rings that project from the roller at different heights.

While suitable for particular applications, this approach has limited flexibility. For example, if the narrowest or shallowest of the grooves is positioned near a given end of the male roller, and the operator needed to re-position the narrowest or farthest-projecting O-ring near the opposite end or along a medial region, another roller with a different arrangement of grooves would be needed.

Other disadvantages arise from the nature of the O-rings, which when suitable for scoring have extremely small diameters, e.g. in the range of 0.025 to 0.035 inches (0.63-0.88 mm). This renders the O-rings subject to excessive force concentrations that can lead to tearing, cracking or other damage when the rings are stretched to install them onto a male roller. Also, since the tensile force necessary to positively secure the O-rings on the roller is large in comparison to the O-ring cross-sectional area, the ring is susceptible to cold flow and relaxation of the tension, which over time diminish the tension and provide a less secure mounting of the ring.

Accordingly, the present invention has several aspects directed to one or more of the following objects:

- to provide a resilient annular scoring tool configured to accommodate higher tensile forces for a more secure mounting around a grooved roller, with more stability in terms of maintaining the desired position of the radially outward or working end of the scoring tool;
- to provide a resilient annular scoring tool that is less susceptible to wear and fatigue from repeated elongations during installation onto and removal from rigid grooved rollers;

- to provide a roller assembly adapted to accommodate differences in size, shape, degree of radial protection and axial location of scoring blades while using a single grooved roller; and
- to provide a paper processing roller assembly that accommodates different combinations of, and different axial spacings between, scoring tools, perforating tools and other processing tools in a single roller arrangement.

SUMMARY OF THE INVENTION

To achieve these and other objects, there is provided a paper scoring system. The scoring system includes a cylindrical first roller rotatable on a first axis and having a circumferential tool-retaining groove with a first width. The system further includes a flexible scoring tool comprising an annular base having a base width adapted for a nesting engagement in the tool-retaining groove to removably secure the scoring tool for rotation with the first roller. An annular scoring feature projects radially outward from the base and has a scoring feature width less than the base width. A cylindrical second roller is rotatable on a second axis and has a circumferential tool-receiving groove with a second width greater than the scoring feature width. The first and second rollers are positionable in a working configuration in which the first and second rollers are axially aligned in spaced apart relation with the first and second axes substantially parallel, whereby the scoring feature extends into the tool-receiving groove.

An advantage of forming the resilient annular scoring tool with a base in addition to the scoring feature, arises from the fact that the base is not constrained by the functional requirements of the scoring feature. Scoring features of different sizes and shapes can be used in conjunction with bases of the same size and shape, to be accommodated by the same groove in the rigid roller. Secondly, the base can have a much larger width (axial direction) than the scoring feature or blade, to impart increased strength and structural stability to the scoring tool. For example, a base supporting a 0.025 inch (width) scoring blade can have a width of 0.125 inches. The much larger scoring tool can be elastically elongated (stretched) with minimal concern that the elongation will exceed elastic limits of the polymeric materials typically involved. The larger surface area of the base is contiguous with a much larger surface area of the roller, in particular the groove, which provides a more secure and stable mounting of the scoring tool.

Another aspect of the present invention is a scoring roller assembly for use in a paper processing system. The roller assembly includes a cylindrical first roller rotatable on a first axis and having a circumferential tool-retaining groove with a first width. The assembly includes a set of scoring tools comprising a first flexible scoring tool having a first annular base and a first annular scoring feature narrower than the first annular base and projecting radially outward from the first annular base, and a second flexible scoring tool having a second annular base and a second annular scoring feature narrower than the second annular base and projecting radially outward from the second annular base. Each of the first and second annular bases is adapted for a nesting engagement within the tool-receiving groove to removably secure the associated scoring tool for rotation with the roller. The first and second scoring features have respective and different first and second radial-axial profiles.

In one particularly preferred approach, the first and second flexible scoring tools are provided in different colors or otherwise given visible indicia so that a user can readily distinguish the tools, and in conjunction with larger scoring tool sets, distinguish among scoring tools with many different sizes and shapes of scoring blades.

Another aspect of the present invention is a paper processing roller assembly. The roller assembly includes an elongate support member rotatable about a longitudinal axis and having a support member. A head is disposed at a first end of the support member and has a head diameter larger than the support member diameter. The assembly includes a sleeve set comprising an annular paper processing sleeve adapted for a removable surrounding engagement with the support member. The processing sleeve has an annular outer surface and a circumferential processing feature projecting radially outward from the outer surface. The processing sleeve and processing feature are selected from the group consisting of: scoring sleeves with scoring features, perforating sleeves with perforating features, cutting sleeves with cutting features and compression sleeves with compression features. A sleeve holding member is disposed proximate a second and opposite end of the support member in an axially fixed working position to frictionally maintain the sleeve set between the sleeve holding member and the head for rotation with the support member. A coupling feature is adapted to releasably secure the sleeve holding member in the working position.

Using sleeves corresponding to a variety of different paper processing functions and different spacers between functional sleeves, a wide variety of functional accommodations and spacings can be achieved using a single support member. Rapid changeover from one set of functions to another is facilitated by the fact that removing and replacing sleeves is accomplished simply by disconnecting and then reconnecting the sleeve holding member.

IN THE DRAWINGS

For a further understanding of the foregoing and other advantages, reference is made to the following detailed description and to the drawings, in which.

DETAILED DESCRIPTION OF THE PREFERRED EMBODIMENTS

Figure 1:
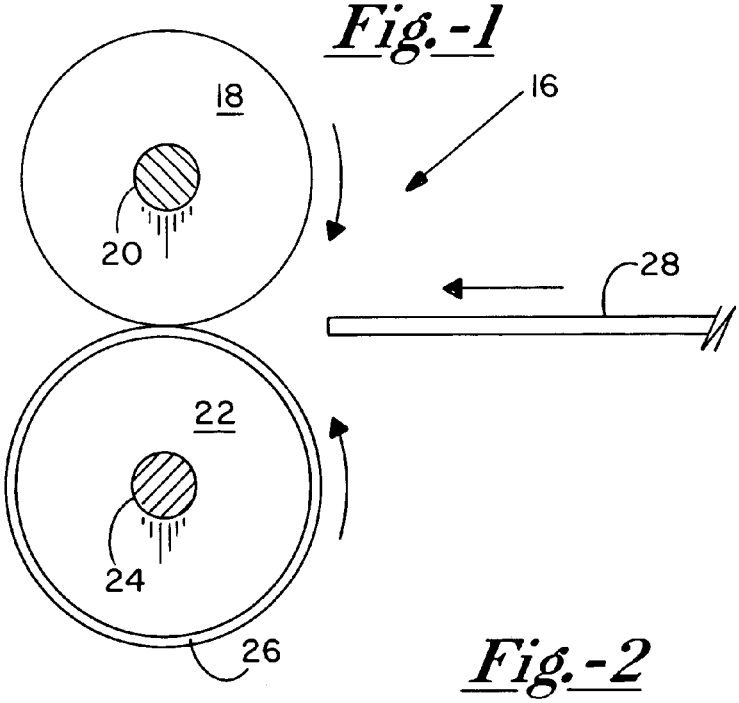
FIG. 1 is a schematic side elevation of a paper processing system constructed according to the present invention.

Turning now to the drawings, where shown in FIG. 1 a system 16 for processing paper and cardboard stock, more particularly a scoring or creasing stage of the system. System 16 includes a female roller 18 mounted on a shaft 20 for rotation with the shaft about a female shaft axis that would appear as a point if represented in FIG. 1. A male roller 22 is mounted on a shaft 24 for rotation therewith about a male shaft axis parallel to the female shaft axis. The male roller supports an annular, resilient scoring tool or scoring ring 26, integrally so that scoring tool 26 rotates with the male roller.

Paper stock 28, which can take the form of a continuous web or separate sheets, is fed toward the interface of rollers 18 and 22. The rollers are counter-rotated, i.e. in opposite direction as indicated by the arrows, to move the paper stock leftward as viewed in the Figure. Scoring tool 26, in cooperation with a groove formed in female roller 18 (FIG. 2), forms a linear score or crease in paper stock 28 in the direction of travel. Rollers 18 and 22 are rigid, preferably formed of steel.

Figure 2:
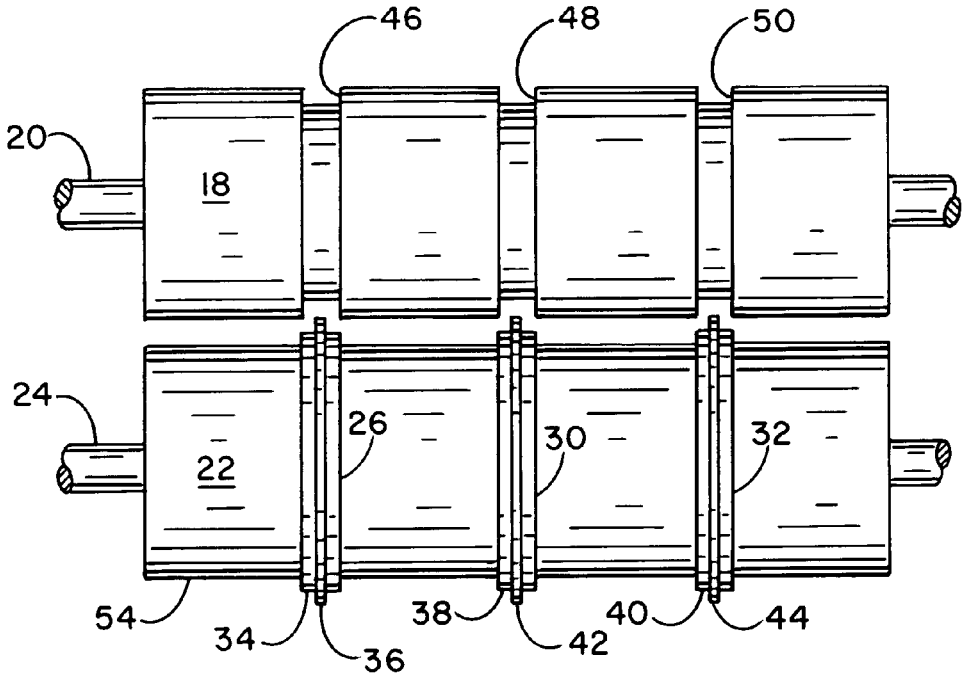
FIG. 2 is an end view of the system shown in FIG. 1.

As seen in FIG. 2, scoring tool 26 and two additional resilient annular scoring tools 30 and 32 are mounted to male roller 22, integrally for rotation with the roller. Each of the scoring tools, preferably unitary in construction, includes an annular base designed for removable mounting to the male roller, and a circumferential scoring feature or scoring blade axially centered relative to the base and projecting radially outwardly from the base. In particular, scoring tool 26 has a base 34 and a scoring feature 36, and scoring tools 30 and 32 have bases 38 and 40 and scoring features 42 and 44, respectively.

Several tool-receiving grooves, indicated at 46, 48, and 50, are formed into female roller 18 and extend circumferentially about the female roller. Grooves 46-50 are spaced apart axially from one another such that when rollers 18 and 22 are in a paper processing or working configuration, each of scoring features 36, 42 and 44 extends slightly into its associated one of grooves 46, 48, and 50.

The axial width and radial depth of grooves 46, 48 and 50 can vary in accordance with the material and thickness of paper stock 28, the paper grain, moisture content, ink coverage, and requirements of the job at hand. The axial width and radial height of scoring features 36, 42 and 44 can vary accordingly. In all cases, the scoring feature is narrower than its associated tool-receiving groove.

Figure 3:
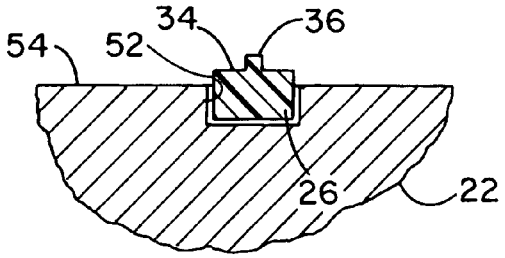
FIG. 3 is an enlarged sectional view showing part of a paper scoring roller of the system.

As seen in FIG. 3, scoring tool 26 resides in a tool-retaining groove 52 in male roller 22. Groove 52 is formed circumferentially about the male roller with a substantially uniform axial width and radial depth. The profile of scoring tool 26, conveniently thought of as a radial-axial profile, is uniform over the tool circumference. The axial width of base 34 is substantially the same or slightly less than the width of groove 52, to provide for a nesting engagement or close fit of the base within the groove. The scoring tool preferably is formed of an elastomeric polymer, e.g. urethane, so that it can be removed from roller 22 and reinserted into groove 52 through elastic elongation. Preferably scoring tool 26 is configured with a base inner diameter slightly less than an inner diameter of groove 52, so that base 34 is maintained in slight tension when residing in groove 52 as shown. The close fit and tension provide for an integral engagement of the scoring tool and male roller 22 to ensure that the scoring tool rotates with the male roller.

Base 34 has a radial height greater than the radial depth of groove 52. As a result, a portion of the base extends radially outward beyond an outer surface 54 of the male roller when the scoring tool is installed. This outer portion can be gripped to facilitate removal of the scoring tool from the groove. In use, the outer portion of base 34 provides shoulders on opposite sides of scoring feature 36 that press against the paper as it is being scored. This helps to drive the paper forward, and improves forward motion control by counteracting any tendency of the paper to drift laterally.

Base 34 is considerably wider than scoring feature 36, for example having an axial width of about one-eighth of an inch (3 mm) in combination with scoring features having widths in the range of 0.025-0.035 inches (0.63-0.88 mm). Preferably, the base width is at least triple the scoring feature width. As compared to conventional systems in which the scoring tool consists of an O-ring or other member with the 0.025-0.035 inch width, scoring tool 26 is much stronger and affords a more stable mounting to the male roller. As compared to the much smaller O-ring, scoring tool 26 can be stretched repeatedly for installation onto and removal from the male roller without undue concentrations of stress that can lead to cracking and tearing of the scoring tool polymer. Further, as noted above, flexibility is afforded when a variety of different sized scoring features are used with bases of the same width, eliminating the need to substitute different male rollers with different sized grooves.

Bases 38 and 40 are mounted within respective tool-retaining grooves (not illustrated) in the same fashion as base 34. Preferably all of the bases have the same axial width, regardless of any difference in the radial-axial profiles (in height, width or both) of the associated scoring features or blades. This permits an interchangeable mounting of different scoring tools in different tool-retaining grooves, whereby a single male roller and set of scoring tools can perform multiple combinations of scoring operations.

The other tool-retaining grooves in male roller 22 are similar in profile to groove 52. All groves preferably have the same axial width to enable an interchangeable mounting of scoring tools 26, 30 and 32 in the tool-retaining grooves. At the same time, it is a feature of the invention that the tool-retaining grooves can have different radial depths. As a result, the distance by which a given scoring feature projects from the outer surface of male roller 22 can vary, depending on the particular groove in which the scoring tool resides.

Figure 4:
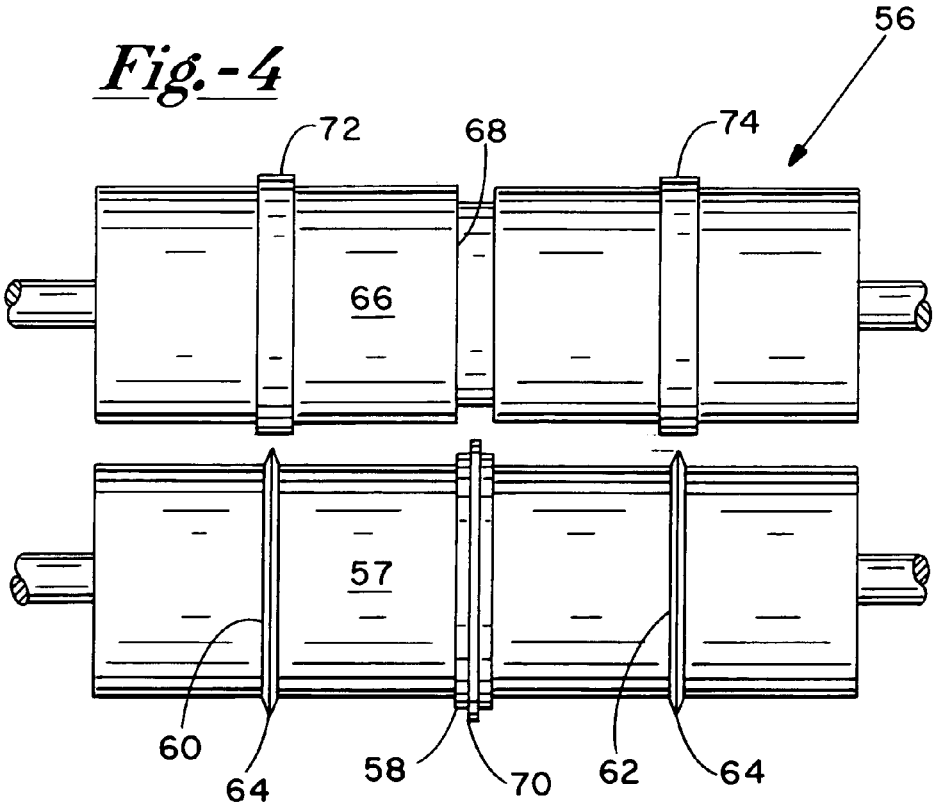
FIG. 4 is an end view similar to that in FIG. 2 showing an alternative embodiment paper processing system.

FIG. 4 illustrates an alternative embodiment paper processing system 56 in which a male roller 57 supports a resilient annular scoring tool 58 in the manner previously described. On opposite sides of scoring tool 58 are perforating tools 60 and 62. Each perforating tool is comprised of substantially rigid perforating elements 64 extended radially outward from roller 57 and arranged circumferentially about the roller.

A female roller 66, supported for counter rotation relative to the male roller as before, has a circumferential tool-receiving groove 68 opposite a scoring feature 70 of scoring tool 58. Hard plastic bands 72 and 74 surround roller 66 on opposite sides of groove 68, disposed for interaction with perforating tools 60 and 62, respectively.

As before, a variety of scoring tools having the same size base combined with scoring features with different radial-axial profiles can be used in combination with the male roller to meet a variety of different creasing and other processing requirements.

Figure 5:
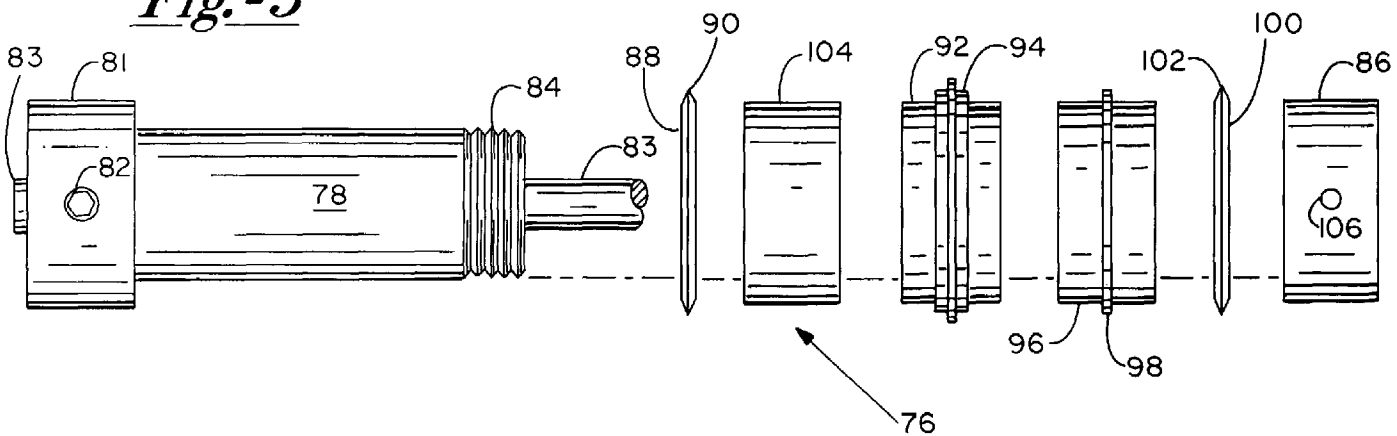
FIG. 5 is an exploded-parts view of an alternative embodiment paper processing device.

FIG. 5 illustrates an alternative embodiment paper processing device in the form of a male roller assembly 76. The assembly includes an elongated tubular support body 78 with a larger-diameter head 80 mounted to the body at one end. A hexagonal-head threaded fastener 82 extended radially through head 80 is used to secure the head and body to a shaft 83. At its opposite end, tubular body 78 has male threads 84.

A variety of tools are supported by discs or sleeves that can be slidably inserted onto body 78 and held frictionally in place by securing a sleeve anchor 86 to the body. Illustrated examples include: a cutting sleeve 88 with a cutting blade 90 circumferentially disposed about the sleeve; a scoring sleeve 92 supporting an annular resilient scoring tool 94; a compression sleeve 96 supporting an annular resilient compression tool 98; and a perforating sleeve 100 supporting a perforating tool comprised of rigid perforating elements 102.

In addition to the processing sleeve, any number of spacing sleeves or discs 104 can be provided to set the axial spacings between adjacent tools mounted on body 78. Of course, particular tools and spacings between them are selected to meet project requirements. The tools and spacers are frictionally held to rotate with body 78 by securing sleeve anchor 86 to the body. This can be accomplished with female threads formed along the annular inner surface of anchor 86 for engagement with male threads 84, or with a threaded fastener in a radial opening 106 through the anchor.

Figure 6:
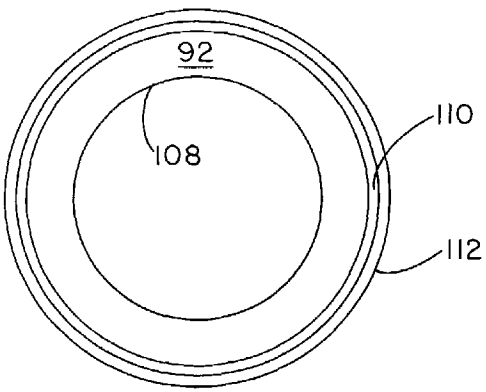
FIG. 6 is a frontal elevation of a paper processing sleeve of the device shown in FIG. 5.

Scoring sleeve 92, as shown in FIG. 6, includes a central opening 108 sized for a sliding engagement with tubular body 78 and having a smooth inner surface. In a manner similar to male rollers 22 and 57, sleeve 92 incorporates a circumferential tool-retaining groove in which scoring tool 94 is removably mounted. The scoring tool includes a base 110 mounted directly in the tool-retaining groove, and a narrower scoring feature or blade 112 projecting radially outward from the base.

In one approach, tubular body 78 has the same diameter and function as shaft 24. Alternatively, body 78 can have a central opening sized for slidable insertion of the body onto a shaft such as shaft 24. The tubular body incorporates threaded fasteners or other means to secure it to the shaft it surrounds.

Figure 7:
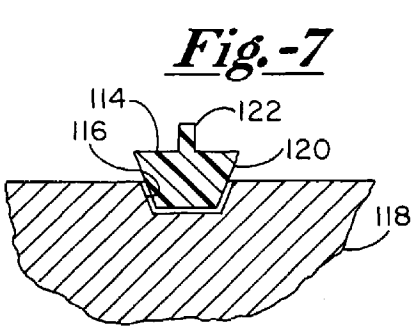
FIG. 7 is a view similar to FIG. 3 showing an alternative embodiment scoring tool and tool-retaining groove.

FIG. 7 illustrates an alternative scoring tool 114 removably seated in a tool-retaining groove 116 of a roller or sleeve 118. In this approach, opposite sides of the base and tool-retaining groove are inclined to converge in the radially inward direction. The axial width of base 120 thus varies, but as before remains considerably larger than the width of scoring feature 122, preferably by a factor of at least three.

Figure 8:
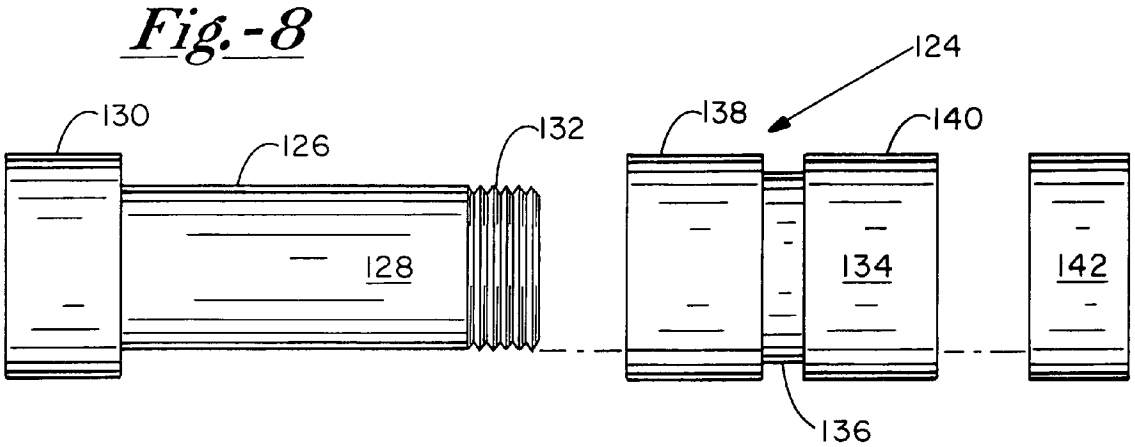
FIG. 8 is an exploded-parts view of an alternative embodiment female roller assembly.

FIG. 8 illustrates a female roller assembly 124 suitable for use with male roller 57 (FIG. 4) in lieu of roller 66. The assembly includes a support member 126 preferably formed of steel. The support member includes an elongate tubular shaft 128 and a head 130 at one end of the shaft. At the other end, shaft 128 is provided with male threads 132.

An annular sleeve 134 has an internal lengthwise opening (not shown) to facilitate a removable mounting of the sleeve in surrounding relation to shaft 128. Sleeve 134 incorporates a medially located circumferential tool-receiving groove 136. On opposite sides of the groove are regions 138 and 140 having outer diameters comparable to an outer diameter of head 130.

Sleeve 134 is formed of a polymeric material, e.g. a glass filled nylon. As a result, sleeve regions 138 and 140 function in a manner similar to bands 72 and 74 in providing backing structures that cooperate with perforating devices similar to tools 60 and 62. A sleeve anchor 142, having an internal opening provided with female threads complementary to male threads 132, can be removably secured to shaft 128 when sleeve 134 surrounds the shaft to releasably fix the sleeve relative to the shaft.

As compared to female roller 66, roller assembly 124 affords several advantages. One is that in the event of damage or wear to groove 136 or either of regions 138 and 140, effective roller operation can be restored by replacing sleeve 134 rather than replacing the entire roller, at considerably reduced cost. Secondly, a combination of a single support member 126 and a variety of different sleeves affords the flexibility to meet a variety of processing requirements without the need for a corresponding set of complete rollers.

Figure 9:
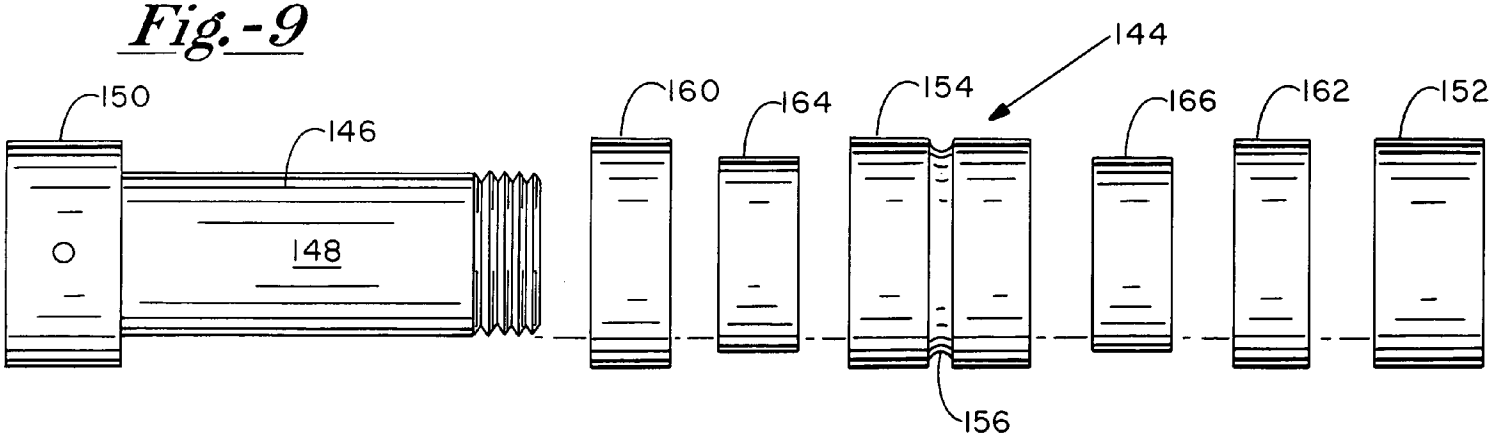
FIG. 9 is an elevation of a further alternative embodiment female roller assembly.

FIG. 9 illustrates a female complementary roller assembly 144 designed to provide flexibility for custom processing jobs, similar to that afforded by roller assembly 76. Roller assembly 144 includes a steel support member 146 having a tubular shaft 148 and a head 150 at one end of the shaft. A sleeve anchor 152, similar in construction to anchors 86 and 142, threadedly engages the shaft to retain a set of complementary sleeves fixed in relation to the tubular shaft between the anchor and the head.

The complementary sleeves include a sleeve 154 with a circumferential tool-receiving groove 156. At opposite ends of the sleeve set are backing sleeves 160 and 162 that are similar in function to bands 72 and 74. Finally, the backing sleeves are separated from sleeve 154 by respective spacing sleeves 164 and 166.

All of the complementary sleeves can be formed of glass filled nylon or another suitable polymer, thus to achieve the advantages afforded by annular sleeve 134. In addition, sleeves of the type shown in FIG. 9 can be provided in different widths (in the axial direction) and arranged in different sequences to meet a wide variety of custom processing requirements.

Figure 10:
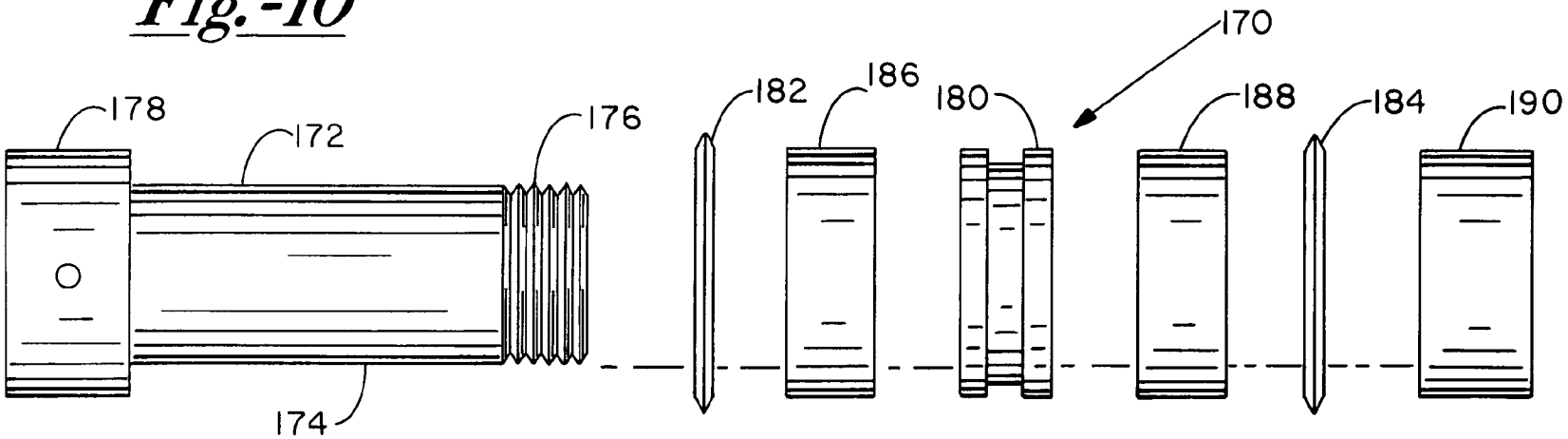
FIG. 10 illustrates a male roller assembly adapted for use with the female roller assembly of FIG. 9.

FIG. 10 illustrates a male roller assembly 170 adapted for use with female roller assembly 144. The assembly includes a support member 172 with a tubular shaft 174 with male threads 176 at one end, and a head 178 at the opposite end. A set of sleeves adapted for removable mounting on shaft 174 includes a scoring sleeve 180 (with the scoring tool removed), perforating sleeves 182 and 184 on opposite sides of the scoring sleeve, and spacing sleeves 186 and 188 between sleeve 180 and the perforating sleeves. An anchor 190 is adapted for threaded engagement with shaft 174 to secure the sleeves on the shaft.

Thus in accordance with the present invention, a single shaft can be fit alternatively with different combinations of tool bearing sleeves to accommodate different operations featuring different sizings and spacings. In this version and others, the base is considerably larger than the scoring feature. Consequently, the scoring tool more securely and more accurately positions the scoring feature and is less susceptible to tearing, cracking, and other damage when elastically elongated during installation and removal. In addition, the use of a standard size base in conjunction with scoring tools of different profiles enables a single roller to be used in a wide variety of different creasing applications.

What is claimed is:

1. A paper scoring system, including:

a cylindrical first roller rotatable on a first axis and having a circumferential tool-retaining groove with an axial first width;

a flexible scoring tool comprising an annular base having an axial base width adapted for a nesting engagement in the tool-retaining groove to removably secure the scoring tool for rotation with the first roller, and an annular scoring feature projecting radially outward from the base, the scoring feature having a radial scoring feature height and an axial scoring feature width, wherein the scoring feature width is less than the base width and substantially uniform over a majority of the scoring feature height; and a cylindrical second roller rotatable on a second axis and having a circumferential tool-receiving groove with an axial second width greater than the scoring feature width;

wherein the first and second rollers are positionable in a working configuration in which the first and second rollers are axially aligned in spaced apart relation and the first and second axes are substantially parallel, whereby the scoring feature extends into the tool-receiving groove.

2. The scoring system of claim 1 wherein:

the tool-retaining groove has a uniform radial-axial profile over its entire circumferential length.

3. The system of claim 2 wherein:

the tool-retaining groove has a radial groove depth less than the first groove width.

4. The system of claim 1 wherein:

the annular base has a rectangular radial-axial profile.

5. The system of claim 4 wherein:

the annular base has a radial height less than the base width.

6. The system of claim 5 wherein:

the height is greater than a depth of the tool-retaining groove.

7. The system of claim 4 wherein:

the scoring feature width is less than one-third of the base width.

8. The system of claim 1 wherein:

the base is configured to be in tension when in said nesting engagement in the tool-retaining groove.

9. The system of claim 1 wherein:

the second width of the tool-receiving groove is less than the first width of the tool-retaining groove.

10. The system of claim 1 wherein:

the first roller has a plurality of the tool-retaining grooves, each tool-retaining groove having said first width whereby the scoring tool is adapted for said nesting engagement in each of the tool-retaining grooves.

11. The system of claim 1 further including:

a plurality of additional flexible scoring tools having respective annular bases having said base width, whereby the scoring tools are interchangeably insertable into the tool-retaining groove.

12. The system of claim 11 wherein:

the additional scoring tools have respective scoring features with different radial-axial profiles.

13. The system of claim 12 wherein:

the flexible scoring tools incorporate visible indicia to facilitate a user in distinguishing among the different scoring features.

14. A paper scoring system, including:

a cylindrical first roller rotatable on a first axis and having a circumferential tool-retaining groove with an axial first width;

a flexible scoring tool comprising an annular base having an axial base width adapted for a nesting engagement in the tool-retaining groove to removably secure the scoring tool for rotation with the first roller, and an annular scoring feature projecting radially outward from the base and having an axial scoring feature width less than the base width; and a cylindrical second roller rotatable on a second axis and having a circumferential tool-receiving groove, the tool-receiving groove having an axial second width greater than the scoring feature width and less than the first width;

wherein the first and second rollers are supportable in a working configuration in which they are axially aligned in spaced apart relation with the first and second axes substantially parallel, and with the scoring feature extending into the tool-receiving groove.

15. The system of claim 14 wherein:

the tool-retaining groove has a uniform radial-axial profile over its entire circumferential length.

16. The system of claim 15 wherein:

the tool-retaining groove has a radial groove depth less than the first groove width.

17. The system of claim 14 wherein:

the annular base has a rectangular radial-axial profile.

18. The system of claim 17 wherein:

the annular base has a radial height less than the base width.

19. The system of claim 18 wherein:

the radial height is greater than a radial depth of the tool-retaining groove.

20. The system of claim 17 wherein:

the scoring feature width is less than one-third of the base width.

21. The system of claim 14 wherein:

the base is configured to be in tension when in said nesting engagement in the tool-retaining groove.

22. The system of claim 14 wherein:

the first roller has a plurality of the tool-retaining grooves, each tool-retaining groove having said first width whereby the scoring tool is adapted for said nesting engagement in each of the tool-retaining grooves.

23. The system of claim 14 wherein:

said flexible scoring tool comprises a plurality of the flexible scoring tools with respective annular bases having said base width, whereby the scoring tools are interchangeably insertable into the tool-retaining groove.

24. The system of claim 23 wherein:

the flexible scoring tools have respective scoring features with different radial-axial profiles.

25. The system of claim 14 wherein:

the scoring feature width, over a majority of a radial height of the scoring feature, is substantially uniform.

26. A paper scoring system, including:

a cylindrical first roller rotatable on a first axis and having a circumferential tool-retaining groove with an axial first width;

a flexible scoring tool comprising an annular base having a radial base height and an axial base width that is substantially uniform over a majority of the base height, wherein the base is adapted for a nesting engagement in the tool-retaining groove to removably secure the scoring tool for rotation with the first roller, and an annular scoring feature projecting radially outward from the base and having a radial scoring feature height and an axial scoring feature width, wherein the scoring feature width over a majority of the scoring feature height is at most one-third of the base width; and a cylindrical second roller rotatable on a second axis and having a circumferential tool-receiving groove with an axial second width greater than the scoring feature width;

wherein the first and second rollers are supportable in a working configuration in which the first and second rollers are axially aligned in spaced apart relation and the first and second axes are substantially parallel, whereby the scoring feature extends into the tool-receiving groove.

27. The scoring system of claim 26 wherein:

the tool-retaining groove has a uniform radial-axial profile over its entire circumferential length.

28. The system of claim 26 wherein:

the annular base has a rectangular radial-axial profile.

29. The system of claim 28 wherein:

the annular base has a radial height less than the axial base width.

30. The system of claim 29 wherein:

the radial height is greater than a radial depth of the tool-retaining groove.

31. The system of claim 26 wherein:

the base is configured to be in tension when in said nesting engagement in the tool-retaining groove.

32. The system of claim 26 wherein:

the second width of the tool-receiving groove is less than the first width of the tool-retaining groove.

33. The system of claim 26 wherein:

the first roller has a plurality of the tool-retaining grooves, each tool-retaining groove having said first width whereby the scoring tool is adapted for said nesting engagement in each of the tool-retaining grooves.

34. The system of claim 26 wherein:

said flexible scoring tool comprises a plurality of additional flexible scoring tools with respective annular bases having said base width, whereby the scoring tools are interchangeably insertable into the tool-retaining groove.

35. The system of claim 34 wherein:

the additional scoring tools have respective scoring features with different radial-axial profiles.

36. The system of claim 26 wherein:

the scoring feature width, over a majority of the scoring feature height, is substantially uniform.

* * * * *